US009831571B2

(12) United States Patent
Kaneoya

(10) Patent No.: US 9,831,571 B2
(45) Date of Patent: Nov. 28, 2017

(54) RELAY TERMINAL BLOCK

(71) Applicant: Mitsubishi Electric Corporation, Tokyo (JP)

(72) Inventor: Shinya Kaneoya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/529,110

(22) PCT Filed: Jan. 8, 2015

(86) PCT No.: PCT/JP2015/050343
§ 371 (c)(1),
(2) Date: May 24, 2017

(87) PCT Pub. No.: WO2016/110975
PCT Pub. Date: Jul. 14, 2016

(65) Prior Publication Data

US 2017/0264030 A1 Sep. 14, 2017

(51) Int. Cl.
*H01R 9/26* (2006.01)
*H01R 9/24* (2006.01)

(52) U.S. Cl.
CPC ..... *H01R 9/2608* (2013.01); *H01R 9/2416* (2013.01)

(58) Field of Classification Search
CPC ..... H01R 9/2416; H01R 9/2608
See application file for complete search history.

(56) References Cited

U.S. PATENT DOCUMENTS 3,042,896 A 7/1962 Doktor
3,636,502 A * 1/1972 Wallace ..... H01R 4/027 439/626

(Continued)

FOREIGN PATENT DOCUMENTS

JP S54-173290 U 12/1979
JP S59-192276 U 12/1984

(Continued)

OTHER PUBLICATIONS

International Search Report of the International Searching Authority dated Feb. 17, 2015 for the corresponding international application No. PCT/JP2015/050343 (and English translation).

(Continued)

*Primary Examiner* — James Harvey
(74) *Attorney, Agent, or Firm* — Posz Law Group, PLC

(57) ABSTRACT

A relay terminal block fixed to a fixing part by a screw includes a main body having a first surface facing the fixing part, and a second surface on a rear surface side of the first surface. The main body is formed with a recessed portion depressed from the second surface toward the first surface, a through-hole formed from a bottom surface of the recessed portion through to the first surface, and a protrusion that is provided at an edge of the recessed portion to protrude in a direction away from the second surface. The through-hole is formed to have an inner diameter larger than an outer diameter of a shaft of the screw and smaller than an outer diameter of a head of the screw, and the recessed portion is formed to have an inner diameter larger than the outer diameter of the head of the screw.

2 Claims, 4 Drawing Sheets

(56) References Cited

U.S. PATENT DOCUMENTS

| | | | | |
|---|---|---|---|---|
| 4,194,804 | A * | 3/1980 | Vinch | H01R 9/2416 174/72 A |
| 4,734,061 | A | 3/1988 | Randall, Jr. et al. | |
| 6,093,050 | A * | 7/2000 | Baum | H01C 7/12 439/412 |
| 6,632,108 | B1 * | 10/2003 | Hohlfelder | G08B 25/12 439/709 |
| 2004/0242080 | A1 * | 12/2004 | Lindenbaum | H01R 9/22 439/709 |

FOREIGN PATENT DOCUMENTS

| | | | |
|---|---|---|---|
| JP | S61-083272 | U | 6/1986 |
| JP | S62-191069 | U | 12/1987 |
| JP | S63-004411 | U | 1/1988 |
| JP | S63-137471 | U | 9/1988 |
| JP | H01-100305 | U | 7/1989 |
| JP | H01-168967 | U | 11/1989 |
| JP | H08-222297 | A | 8/1996 |
| JP | H11-250958 | A | 9/1999 |
| JP | 2012-174469 | A | 9/2012 |

OTHER PUBLICATIONS

Extended European Search Report dated Jul. 18, 2016 issued in corresponding EP patent application No. 15781568.9.

* cited by examiner

RELAY TERMINAL BLOCK

CROSS REFERENCE TO RELATED APPLICATION

This application is a U.S. national stage application of International Patent Application No. PCT/JP2015/050343 filed on Jan. 8, 2015, the disclosure of which is incorporated herein by reference.

TECHNICAL FIELD

The present invention relates to a relay terminal block fixed to an air conditioner by a screw.

BACKGROUND

The air conditioner includes an indoor device installed indoors and an outdoor device installed outdoors. The indoor device and the outdoor device are respectively attached with a relay terminal block, to which a power supply line or a crossover line for supplying power is connected. A terminal block that can be connected to the power supply line or the crossover line as disclosed in Patent Literature 1 is used as the relay terminal block.

The relay terminal block is fixed to a fixing part provided in the indoor device and the outdoor device by screws, respectively. In the main body of the relay terminal block, a recessed portion in which a head of the screw enters and a through-hole formed from the bottom surface side of the recessed portion, through which a shaft of the screw pierces, are formed. By piercing the screw into the through-hole and fastening the shaft of the screw to the fixing part, the head of the screw abuts on the bottom surface of the recessed portion, thereby fixing the relay terminal block to the fixing part. That is, by tightening the screw until the head of the screw abuts on the bottom surface of the recessed portion, the tip of the screw is screwed into the fixing part with a sufficient length, and the relay terminal block is thereby fixed reliably.

PATENT LITERATURE

Patent Literature 1: Japanese Patent Application Laid-open No. H08-222297

A power supply system to an indoor device and an outdoor device includes a separate power receiving system in which power supply lines extending from a power supply are respectively connected to the indoor device and the outdoor device to supply power thereto, and an external power receiving system in which the power supply line is connected only to the outdoor device, and power is supplied to the indoor device via a crossover line coupling the indoor device and the outdoor device. A different relay terminal block is generally used for the separate power receiving system and the external power receiving system.

At the time of installing an air conditioner, a relay terminal block may be replaced, to change the power supply system to a desired power supply system. In a replacement work of the relay terminal block, screws that fix the relay terminal block already attached are removed, so as to fix a relay terminal block to be newly attached by screws. The outer diameter of the head of the screw that has fixed the relay terminal block already attached may be larger than that of the head of the screw accompanying the relay terminal block to be newly attached. In this case, the outer diameter of the head of the screw that has fixed the relay terminal block already attached becomes larger than an inner diameter of the recessed portion of the relay terminal block to be newly attached, and the head of the screw may not enter the recessed portion.

In the replacing work of the relay terminal block, if it is attempted to use the screw removed from the relay terminal block already attached in order to fix the relay terminal block to be newly attached, the head of the screw does not enter the recessed portion and the tip end of the screw is not pierced into the fixing part with a sufficient length. Therefore, fixation of the relay terminal block may be insufficient. However, even if the same screw is used again, the whole area of the outer circumference of the head of the screw abuts against an edge of an entrance of the recessed portion, and the tip end of the shaft of the screw is pierced into the fixing part to some extent. Therefore, a worker may wrongly understand that the relay terminal block has been normally fixed.

SUMMARY

The present invention has been achieved in view of the above problems, and an object of the present invention is to provide a relay terminal block that can be easily recognized that the relay terminal block has been fixed by wrong screws.

In order to solve the afore-mentioned problems, a relay terminal block fixed to a fixing part by a screw according to one aspect of the present invention is so constructed as to include: a main body having a first surface facing the fixing part, and a second surface on a rear surface side of the first surface, wherein the main body is formed with a recessed portion depressed from the second surface toward the first surface, a through-hole formed from a bottom surface of the recessed portion through to the first surface, and a protrusion provided at an edge of the recessed portion to protrude in a direction away from the second surface, the through-hole is formed to have an inner diameter larger than an outer diameter of a shaft of the screw and smaller than an outer diameter of a head of the screw, and he recessed portion is formed to have an inner diameter larger than the outer diameter of the head of the screw.

The relay terminal block according to the present invention can be easily recognized that the relay terminal block has been fixed by wrong screws.

DETAILED DESCRIPTION

Exemplary embodiments of a relay terminal block according to the present invention will be explained below in detail with reference to the accompanying drawings. The present invention is not limited to the embodiments.

First Embodiment

Figure 1:
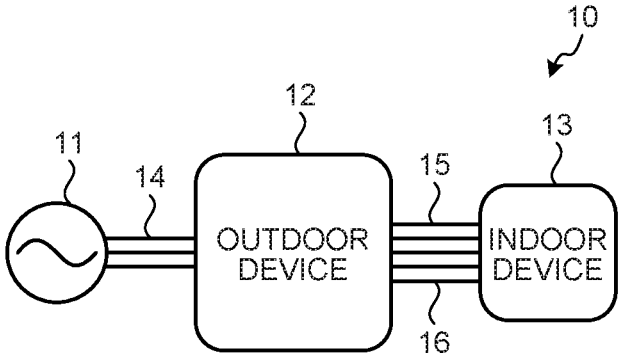
FIG. 1 is a diagram illustrating an air conditioner having a relay terminal block fixed thereto according to a first embodiment of the present invention, and illustrating a configuration of an external power receiving system.

An external power receiving system and a separate power receiving system, being power supply systems of an air conditioning apparatus including an indoor device and an outdoor device, are described first. FIG. 1 is a diagram illustrating an air conditioner having a relay terminal block fixed thereto according to a first embodiment of the present invention, and illustrating a configuration of the external power receiving system. An air conditioner 10 includes an outdoor device 12 installed outdoors, and an indoor device 13 installed indoors.

In the air conditioner 10 supplied with power by the external power receiving system, a power supply line 14 extending from a power supply 11 is connected to the outdoor device 12. The outdoor device 12 and the indoor device 13 are connected to each other with a crossover line 15. According to the external power receiving system, power supplied to the outdoor device 12 via the power supply line 14 is also supplied to the indoor device 13 via the crossover line 15. Information is transmitted and received between the outdoor device 12 and the indoor device 13 via a communication line 16.

Figure 2:
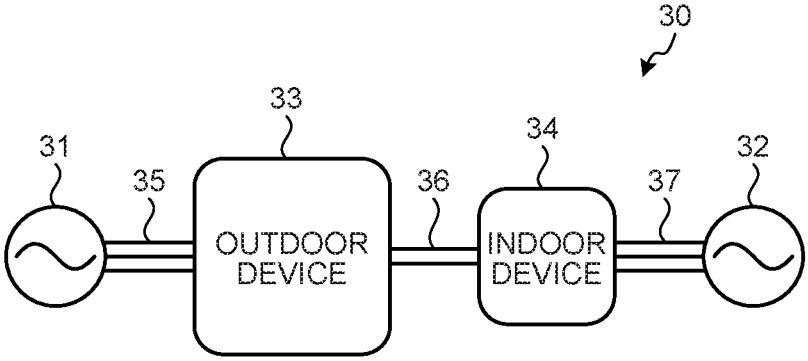
FIG. 2 is a diagram illustrating the air conditioner having the relay terminal block fixed thereto according to the first embodiment, and illustrating a configuration of a separate power receiving system.

FIG. 2 is a diagram illustrating the air conditioner having the relay terminal block fixed thereto according to the first embodiment, and illustrating a configuration of the separate power receiving system. An air conditioner 30 includes an outdoor device 33 installed outdoors, and an indoor device 34 installed indoors.

In the air conditioner 30 supplied with power by the separate power receiving system, a power supply line 35 extending from a power supply 31 is connected to the outdoor device 33. A power supply line 37 extending from a power supply 32 is connected to the indoor device 34. According to the separate power receiving system, power is supplied to the outdoor device 33 and the indoor device 34 respectively from the power supplies 31 and 32. Supply of power between the outdoor device 33 and the indoor device 34 is not performed, but information is transmitted and received between the outdoor device 33 and the indoor device 34 via a communication line 36.

The relay terminal blocks connected to the power supply lines 14, 35, and 37, or the crossover line 15 are provided respectively in the outdoor devices 12 and 33, and the indoor devices 13 and 34 provided in the air conditioner 10 of the external power receiving system and the air conditioner 30 of the separate power receiving system.

Figure 3:
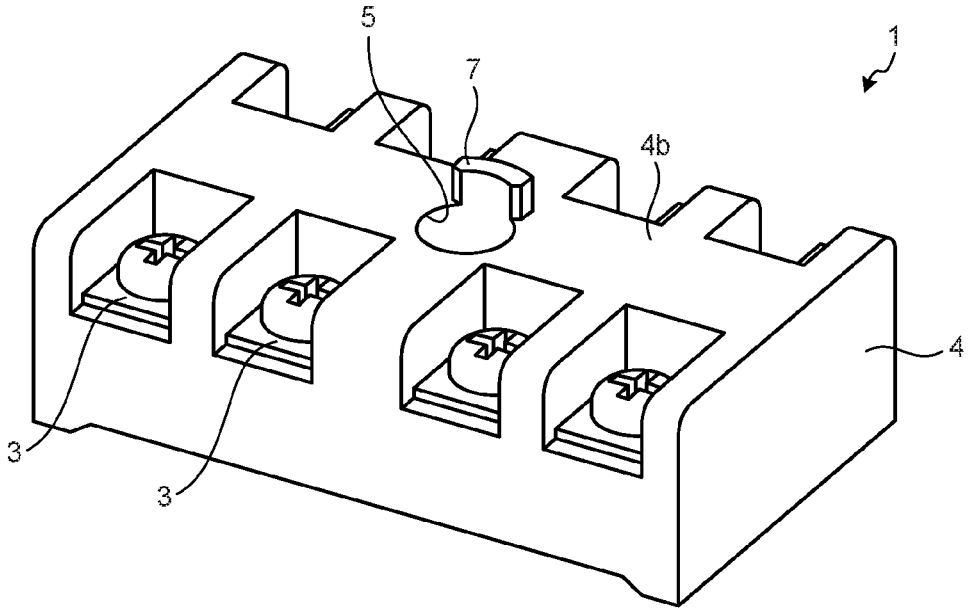
FIG. 3 is a perspective view of the relay terminal block according to the first embodiment.
Figure 4:
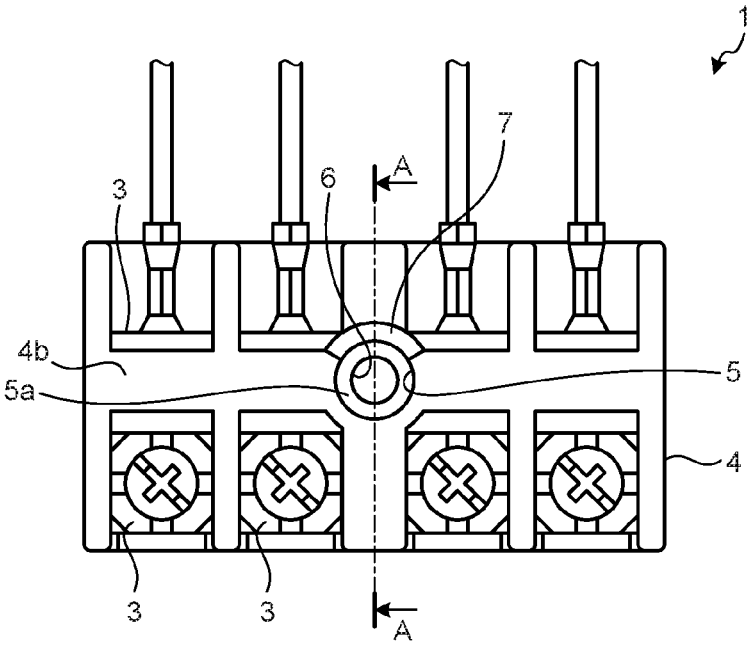
FIG. 4 is a plan view of the relay terminal block according to the first embodiment.
Figure 5:
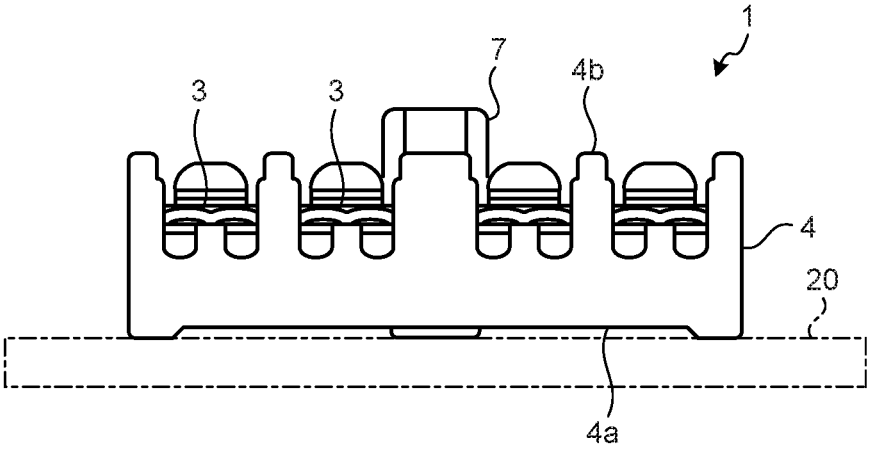
FIG. 5 is a front view of the relay terminal block according to the first embodiment.
Figure 6:
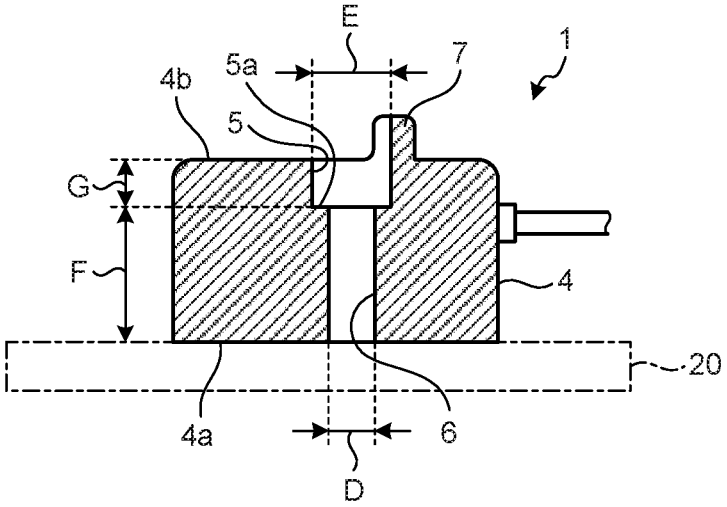
FIG. 6 is a sectional view of the relay terminal block according to the first embodiment, and is a sectional view on arrow along a line A-A illustrated in FIG. 4.

FIG. 3 is a perspective view of the relay terminal block according to the first embodiment. FIG. 4 is a plan view of the relay terminal block according to the first embodiment. FIG. 5 is a front view of the relay terminal block according to the first embodiment. FIG. 6 is a sectional view of the relay terminal block according to the first embodiment, and is a sectional view taken along a line A-A illustrated in FIG. 4.

A relay terminal block 1 is configured to include a main body 4 formed with a plurality of terminal connecting portions 3. The relay terminal block 1 is fixed to a fixing part 20, which is a target to be fixed provided in the outdoor devices 12 and 33, and the indoor devices 13 and 34, by screws.

The main body 4 has a cuboid shape. The main body 4 has a first surface 4*a* facing the fixing part 20, and a second surface 4*b* on a rear surface side of the first surface 4*a*. A recessed portion 5 depressed from the second surface 4*b* toward the first surface 4*a* is formed in the main body 4. A through-hole 6 piercing through to the first surface 4*a* is formed on a bottom surface 5*a* of the recessed portion 5. A protrusion 7 that protrudes in a direction away from the second surface 4*b* is formed at an edge of the recessed portion 5 on the second surface 4*b*. The protrusion 7 is not formed over the entire circumference of the edge of the recessed portion 5, but is formed on a part of the edge thereof.

Figure 7:
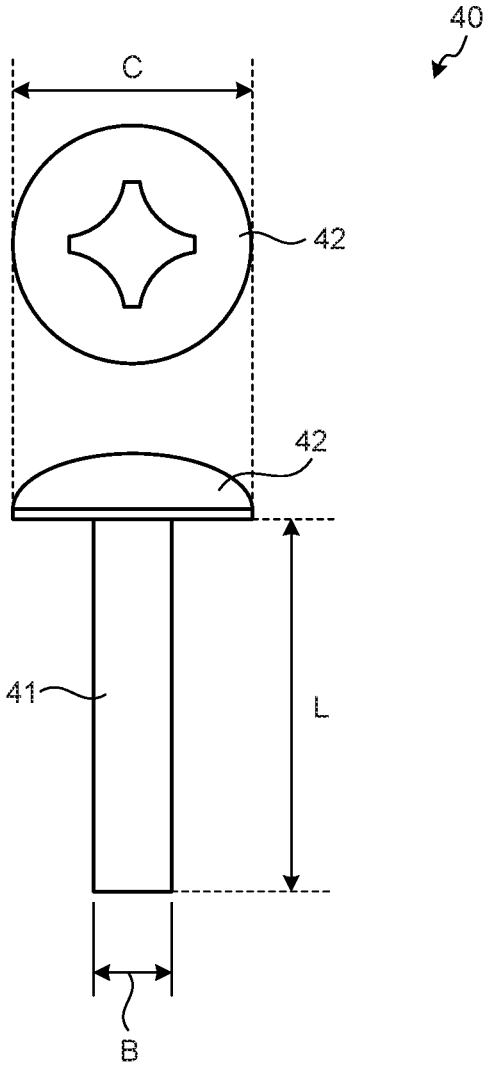
FIG. 7 is a diagram illustrating a screw for fixing the relay terminal block according to the first embodiment.

FIG. 7 is a diagram illustrating a screw for fixing the relay terminal block 1 according to the first embodiment. A screw 40 includes a shaft 41 formed with a screw thread on the outer periphery, and a head 42 provided at one end of the shaft 41 and formed with a larger outer diameter than that of the shaft 41.

The inner diameter D of the through-hole 6 formed in the main body 4 of the relay terminal block 1 is larger than the outer diameter B of the shaft 41 of the screw 40, and smaller than the outer diameter C of the head 42 of the screw 40. The inner diameter E of the recessed portion 5 is formed with a larger inner diameter than the outer diameter C of the head 42 of the screw 40.

In the air conditioner described above, there is a case in which the air conditioner attached with the relay terminal block and shipped, assuming that it is formed as the external power receiving system, is installed with the relay terminal block being replaced by a relay terminal block of the separate power receiving system, or a case in which the air conditioner attached with the relay terminal block and shipped, assuming that it is formed as the separate power receiving system, is installed with the relay terminal block being replaced by a relay terminal block of the external power receiving system. It is assumed here that the inner diameter D of the through-hole 6 of the relay terminal block 1 to be newly attached is 4.2 millimeters, the length F of the through-hole 6 is 12.7 millimeters, the inner diameter E of the recessed portion 5 is 7.5 millimeters, and the depth G of the recessed portion 5 is 4.3 millimeters. It is also assumed that the outer diameter B of the shaft 41 of the screw 40 supplied for fixing the relay terminal block 1 to be newly attached is 3 millimeters, the length L of the shaft 41 is 20 millimeters, and the outer diameter C of the head 42 is 7 millimeters.

In this case, the shaft 41 is caused to pierce through the through-hole 6 and the screw 40 is screwed in the fixing part 20 so that the head 42 enters the recessed portion 5 and abuts on the bottom surface 5*a*, thereby fixing the relay terminal block 1 to the fixing part 20. Therefore, the length of a tip end of the shaft 41 screwed in the fixing part 20 is "20 mm−12.7 mm=7.3 mm".

On the other hand, in a case in which an outer diameter of a head of the screw for fixing the relay terminal block (not illustrated) attached to the air conditioner at the time of shipment is 9.4 millimeters, if the screw is used again mistakenly, the head of the screw cannot enter the recessed portion 5 of the relay terminal block 1 to be newly attached. The head of the screw abuts on the protrusion 7 before abutting on the edge of the recessed portion 5. Because the protrusion 7 is formed on a part of the edge of the recessed portion 5, the head of the screw abuts on the protrusion 7 only at one part of the outer circumference of the head, so that the screw is put in an unstable state. Therefore, a worker easily realizes that the screw for the relay terminal block attached at the time of shipment has been used again mistakenly.

If the protrusion 7 is not formed on the second surface 4*b* of the main body 4 of the relay terminal block 1, the posture of the screw is stabilized because the whole area of the outer circumference of the head of the reused screw abuts on the edge of the recessed portion 5, and thus the worker may not realize the reuse of the screw. In this case, even if the length of the shaft of the screw is 20 millimeters, if the depth G of the recessed portion 5 and the length F of the through-hole 6 are subtracted therefrom, the result is "20 mm−12.7 mm−4.3 mm=3 mm". This means that the tip end of the shaft of the screw is screwed in the fixing part 20 only by 3 millimeters.

As described above, if the screw 40 supplied for the relay terminal block 1 is used, the tip end of the shaft 41 is screwed in the fixing part 20 by 7.3 millimeters. If the lengths of the shafts screwed into the fixing part 20 are compared to each other, it is understood that fixed power of the relay terminal block 1 is weakened by using the screw again, and the relay terminal block 1 is likely to come off.

In the relay terminal block 1 according to the first embodiment, by forming the protrusion 7 on the second surface 4*b* of the main body 4, it becomes easily recognizable that the screw is used again, that is, the relay terminal block 1 is fixed by a wrong screw. Therefore, fixing of the relay terminal block 1 by using an appropriate screw 40 is prompted, and the relay terminal block 1 can be fixed more reliably.

The configuration described in the above embodiment is only an example of the contents of the present invention. The configuration can be combined with other well-known techniques, and it is needless to mention that the present invention can be configured while modifying it without departing from the scope of the invention, such as omitting a part of the configuration.

The invention claimed is:

1. A relay terminal block fixed to a fixing part by a screw, comprising a main body having a first surface facing the fixing part, and a second surface on a rear surface side of the first surface, wherein the main body is formed with a recessed portion depressed from the second surface toward the first surface, a through-hole formed from a bottom surface of the recessed portion through to the first surface, and a protrusion provided at an edge of the recessed portion to protrude in a direction away from the second surface, the through-hole is formed to have an inner diameter larger than an outer diameter of a shaft of the screw and smaller than an outer diameter of a head of the screw, and the recessed portion is formed to have an inner diameter larger than the outer diameter of the head of the screw.

2. The relay terminal block according to claim 1, wherein the protrusion is formed on a part of the edge of the recessed portion.

* * * * *